US011807987B2

(12) United States Patent
Simoncini et al.

(10) Patent No.: US 11,807,987 B2
(45) **Date of Patent: *Nov. 7, 2023**

(54) METHOD FOR MANUFACTURING A STEEL YANKEE DRIER AND A STEEL YANKEE DRIER

(71) Applicant: TOSCOTEC S.P.A., Capannori (IT)

(72) Inventors: Francesco Simoncini, San Lorenzo a Vaccoli (IT); Giulia Masia, Fornacette (IT); Gaetano Passanisi, Capannori (IT); Luca Ghelli, Turin (IT); Leonardo Micheli, Bagni di Lucca (IT); Alessandro Piccinocchi, Pisa (IT); Stefano Marenco, Pinerolo (IT); Jacopo Bibbiani, Pisa (IT)

(73) Assignee: TOSCOTEC S.P.A., Capannori (IT)

( * ) Notice: Subject to any disclaimer, the term of this patent is extended or adjusted under 35 U.S.C. 154(b) by 147 days.

This patent is subject to a terminal disclaimer.

(21) Appl. No.: 17/422,303

(22) PCT Filed: Mar. 23, 2020

(86) PCT No.: PCT/IT2020/050071

§ 371 (c)(1),
(2) Date: Jul. 12, 2021

(87) PCT Pub. No.: WO2020/194360

PCT Pub. Date: Oct. 1, 2020

(65) Prior Publication Data

US 2022/0081836 A1 Mar. 17, 2022

(30) Foreign Application Priority Data

Mar. 26, 2019 (IT) ..... 102019000004371

(51) Int. Cl.
*D21F 5/02* (2006.01)
*D21F 5/18* (2006.01)
*B21D 51/10* (2006.01)

(52) U.S. Cl.
CPC ..... *D21F 5/021* (2013.01); *B21D 51/10* (2013.01); *D21F 5/181* (2013.01)

(58) Field of Classification Search
CPC . D21F 5/021; D21F 5/02; D21F 5/181; D21F 5/18

(Continued)

(56) References Cited

U.S. PATENT DOCUMENTS

2013/0004786 A1* 1/2013 Croopnick ..... C23C 4/10 420/452
2017/0275748 A1* 9/2017 Cheney ..... C22C 38/56
2018/0179705 A1* 6/2018 Sorrentino ..... D21F 5/021

FOREIGN PATENT DOCUMENTS

WO 2016/207752 A1 12/2016

OTHER PUBLICATIONS

International Search Report and Written Opinion dated May 26, 2020 in corresponding International Application No. PCT/IT2020/050071; 8 pages.

(Continued)

*Primary Examiner* — Eric Hug
(74) *Attorney, Agent, or Firm* — Maier & Maier, PLLC

(57) ABSTRACT

A method for manufacturing a steel Yankee drier including a cylindrical steel mantle with two end heads on each of which a corresponding pin is arranged, the cylindrical mantle having an external surface and an internal surface, and the internal surface of the mantle in cooperation with the end heads delimiting an internal chamber of the Yankee drier in which steam can be introduced. The surface protective coating is at least partially formed on the internal surface of (Continued)

the mantle by introducing a predetermined amount of a nickel bath in a volume delimited in a radial direction by the internal surface of the mantle, followed by a permanence of the bath in said volume for a predetermined time. The surface protective coating protects the internal surface of the mantle from corrosive and/or abrasive agents contained in the steam introduced into said chamber.

19 Claims, 15 Drawing Sheets

(58) Field of Classification Search
USPC ..... 162/281, 375
See application file for complete search history.

(56) References Cited

OTHER PUBLICATIONS

International Preliminary Report on Patentability dated Oct. 14, 2020 in corresponding International Application No. PCT/IT2020/050071; 12 pages.

* cited by examiner

METHOD FOR MANUFACTURING A STEEL YANKEE DRIER AND A STEEL YANKEE DRIER

FIELD

The present invention relates to the manufacturing of steel Yankee driers.

Steel Yankee driers are known to have been put on the market relatively recently. In the past, the Yankee driers were made of cast iron.

BACKGROUND

It is known that steel Yankee driers can be manufactured according to several manufacturing techniques. The most frequent embodiments are the following:

- Yankee driers made by calendaring, longitudinal welding and internal machining of the mantle. The mantle is welded through circumferential joints to end heads obtained by metal plates or carbon steel castings.
- Yankee driers whose mantle (manufactured as described above) is bolted to the end heads (also obtained by metal plates or carbon steel castings as described above or obtained by cast iron castings).
- Yankee driers whose mantle is obtained by steel forging, without a longitudinal joint. In this case, the maximum size along the width of the machine is limited by the dimension of the hot rolling and forging plants. Therefore, bigger Yankee driers can be obtained by circumferentially welding two shorter mantles. The mantle thus manufactured can be bolted or welded to the end heads similarly to the procedure described above.

WO2016/207752 discloses a steel Yankee drier comprising a cylindrical mantle and an internal chamber in which steam can be introduced.

The use of steel provides many advantages:

- the better mechanical characteristics of carbon steel compared to cast iron have allowed to reduce the thickness of the mantle; this, in turn, has made it possible to reduce the thermal resistance to the transmission of heat from the heat transfer fluid (typically, pressurized water steam) that is made to flow inside the Yankee drier towards the paper adhered to the external cylindrical surface. This allows a lower temperature difference between the internal heat transfer fluid and the paper on the outside to transmit the same amount of heat. In this way, it is to possible obtain a greater heat exchange with the same internal pressure and more performing Yankee driers and, therefore, it is possible to produce a larger amount of paper with the same diameter and drier speed. The reduction of cylinder dimensions, together with the reduction of temperature and pressure of the heat fluid carrier required to produce the same amount of paper, also leads to improve the overall energy efficiency of the system (in fact, by reducing the temperature and pressure of the steam the thermal dispersions are reduced) with evident advantages in terms of energy consumption or in any case of an economic nature (lower energy consumption for the same production or greater production for the same energy consumption).
- compared to a cast iron Yankee drier, a steel Yankee drier having the same diameter and width not only implies a lower energy consumption but it also has a lower mass. This allows a reduction of the thickness of the structural components. The weight reduction due to the thickness reduction of the structural components is more than the limited increase in weight due to higher density of steel compared to cast iron (7.8 kg/dm$^3$ vs. 7.2 kg/dm$^3$). The mass reduction, that is about 15%-25%, reduces the rotational inertia of the drier. Therefore, a lower power is required to start the latter. Furthermore, the lower rotational inertia implies a higher operative safety: in case of emergency stop, the time required for blocking the drier are considerably reduced.

Further advantages are generally associated with a higher operative flexibility of steel Yankee drier compared to cast iron Yankee driers. In fact, in case of cast iron Yankee driers, a model was required for each size of Yankee drier to be manufactured in the foundry. The manufacturing process rigidity did not allow the manufacturer to easily adapt the Yankee drier geometry to the variable needs of the market.

However, cast iron is more resistant to corrosion compared to steel.

The internal surface of the Yankee drier is always in contact with steam and condensate produced by the heat exchange with the paper to be dried on the external surface of the Yankee drier. The quality of the steam introduced into the Yankee drier must be constantly controlled to avoid corrosion inside the Yankee drier and the components of the steam generation and recirculation units (boiler, thermocompressor, pipes etc.) arranged external to the Yankee drier. Maintaining the required chemical and physical properties of the steam and the condensate, and the absolute absence of oxygen and corrosive substances in the circuits avoid progressive corrosion both in the cast iron and the steel Yankee driers. However, it is noted that steel Yankee driers are more subject to corrosion compared to cast iron Yankee driers in case of deviation from the parameters suggested by the manufacturer. In case of presence, even limited, of oxygen in the steam or acidity exceeding the limits suggested by the manufacturer, steel tends more easily to form layers of unstable oxide that are subject to detachment. This has a double negative effect: over the time, if a correction is not actuated, there is distributed or localized reduction of the thickness of the steel with possible damages to the Yankee drier; moreover, in a relative short time the oxide, once detached, tends to obstruct the condensate collecting tubes. When the condensate collecting tubes are obstructed, the mechanism for extracting the condensate does not work as desired and there is an increase in the fluid dynamic pressure drops and the formation of areas where the heat exchange with the external surface is reduced. A negative effect is that the paper exhibits wet bands due to a non-correct drying thereof.

Such problems can normally be managed by correcting the quality of the steam through chemical analysis of the condensates and use of chemicals for the correction of off-scale parameters. This correction can be facilitated by automatic chemical analysis systems connected to automated chemicals dispensers.

In some cases, however, this correction is difficult to manage. This occurs mainly in two cases:

- paper mills operated by personnel not particularly skilled in the chemical management of the steam production;
- paper mills that do not directly produce the steam but buy the steam from external thermal plants connected with electric power generation plants or plants that use steam for different industrial uses (this situation is frequent when paper mills are located in large industrial areas).

Especially in the second case, since the steam is not specifically produced for use in Yankee driers, the deviation from the correct quality parameters is frequent. Moreover, the paper mill cannot control such parameters to limit their corrosive effect on the internal surface of the Yankee drier. In addition, the lack of control on the steam production process makes it possible to receive steam containing corrosive substances, possibly used during maintenance or washing of the plants located upstream of the paper mill.

SUMMARY

The main object of the present invention is to overcome the above-mentioned drawbacks.

This result is achieved, according to the present invention, by providing a steel Yankee drier having a protective coating on its internal surface, in particular the internal surface through which the most part of the heat exchange with the paper and the steam condensation takes place. Such a Yankee drier has the following characteristics:

- the protective coating is deposited on the base metal providing a high adhesion, with the formation of an effective continuity with the base metal itself. The coating has a reduced porosity (the percentage amount of air or impurities in the volume unit is less than 10%, preferably less than 5%).
- the protective coating is ductile, so as to allow the coating itself to resist, without deteriorating or detaching, to the continuous elastic surface deformations to which the Yankee drier is subjected each time it passes in correspondence of the of the linear pressure area where a presser or pressers are provided (suction press, shoe press, blind-hole press etc.). In particular, the coating is conceived to resist to variations in length of the metal base higher than 1%, preferably higher than 3% m without cracking or detachment;
- the protective coating is a metal coating, or has metallic elements dissolved in a non-metallic matrix, providing high thermal conductivity. The coating, being interposed between the base metal and the heat carrier fluid (steam), must not cause a significant increase of the thermal resistance compared to the same surface without coating. Therefore, the coating has a thermal conductivity coefficient higher than 3 w/m*K, preferably higher than 5 w/m*K.

In order to limit the increase in thermal resistance to the transfer of heat towards the paper, the protective coating has a relatively reduced thickness. In particular, the coating thickness I less than 200 micron. Preferably, the coating thickness is less than 100 micron. Optimal values for the coating thickness, especially on the condensate formation surfaces, are not higher than 50 micron.

The thermal resistance of the heat transfer coated surface is not higher than 10% compared to the same surface non provided with the protective coating. Preferably, said thermal resistance increase is not higher than 2%.

The protective coating must have a high surface hardness so as to adequately resist to the possible erosive effect caused by oxidized particles generated either inside the Yankee drier or from parts external to the Yankee drier (for example generated in the steam circuits) The steam and the condensate exiting the Yankee drier would drag such particles. At the points where the condensate is extracted, the speed of dragging can reach high values due to the reduced passages; the erosive effect deriving from the contact of the entrained particles with the coated surface could have the effect of removing or locally eroding the coating if the latter does not exhibit an adequate hardness. In particular, the hardness of the protective coating, measured at room temperature (25° C.), is higher than 400 HV. Preferably, the hardness of the protective coating at room temperature is higher than 400 HV. Optimal values for the hardness of the protective coating at room temperature are higher than 550 HV.

The protective coating covers at least the surfaces where the condensate is collected. Preferably, the protective coating is applied over the entire surface through which transfer of heat towards the paper takes place.

BRIEF DESCRIPTION OF THE DRAWINGS

These and further advantages and characteristics of the present invention will be more and better understood by the skilled in the art thanks to the following description and the attached drawings, provided by way of example but not to be considered in a limiting sense, in which:

These and further advantages and characteristics of the present invention will be more and better understood by the skilled in the art thanks to the following description and the attached drawings, provided by way of example but not to be considered in a limiting sense, in which:

FIG. 8 shows a mantle mounted on a support allowing the rotation thereof about its longitudinal axis;

FIG. 9 is a section along line H-H of FIG. 8;

FIG. 10 is an enlarged detail showing a possible way of temporary application of a plug to the mantle;

FIG. 11 shows a virtual subdivision of the mantle;

FIG. 12 shows the mantle with the nickel bath inside it;

FIG. 13 is an enlarged detail of FIG. 12;

FIG. 14 schematically shows a mechanism for producing mixing and turbulence in the nickel bath inside the mantle;

FIG. 15 schematically shows the positioning of a cover inside the mantle;

FIG. 16 schematically shows the positioning of a cover inside the mantle;

FIG. 17 schematically shows a rotation of the mantle;

FIG. 18 schematically shows a rotation of the mantle;

FIG. 19 schematically shows further implementation steps of a process for forming a protective coating according to the present invention; and FIG. 20 schematically shows further implementation steps of a process for forming a protective coating according to the present invention.

DETAILED DESCRIPTION OF THE EMBODIMENTS

Figure 1:
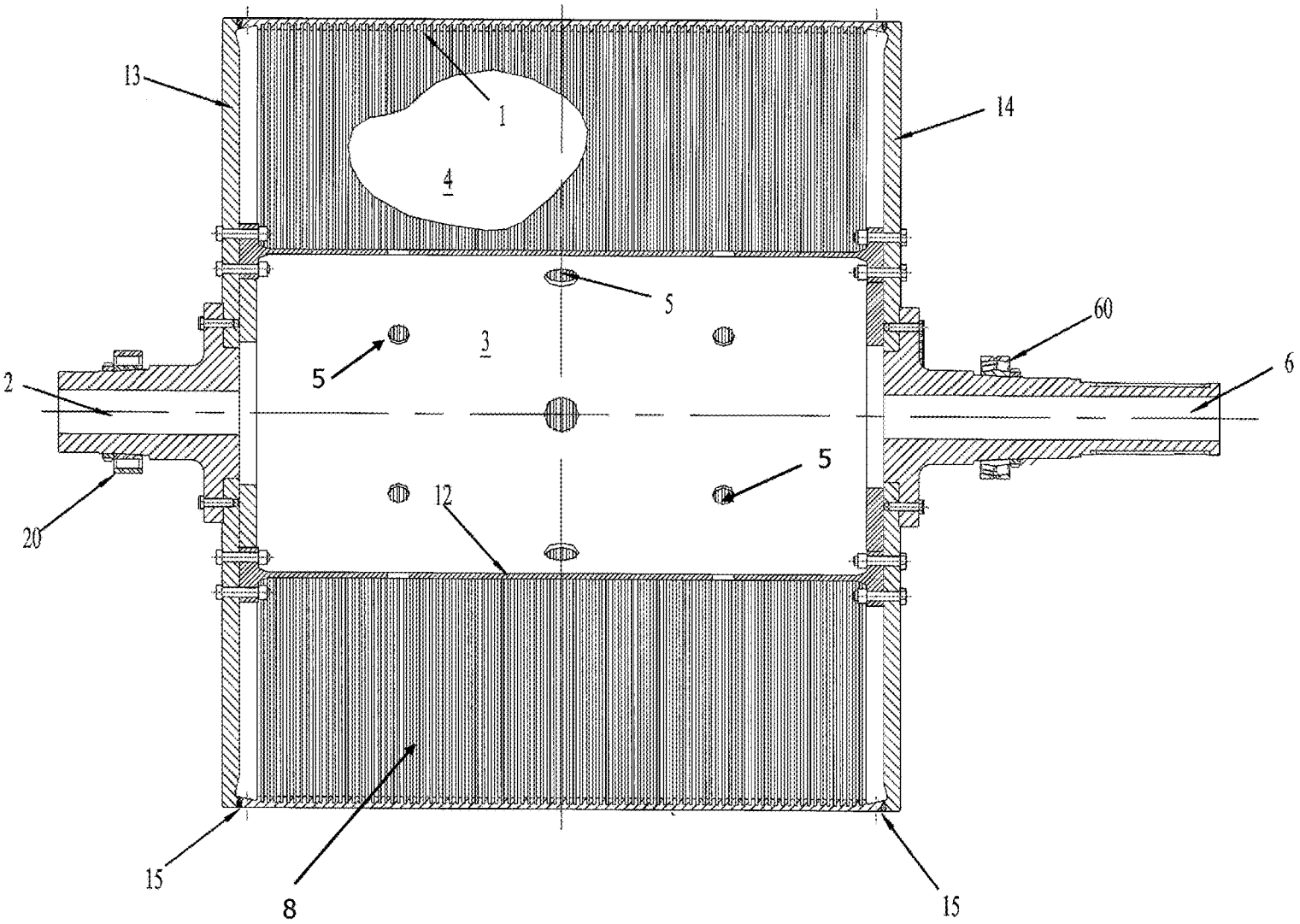
FIG. 1 is a schematic diametral section view of a steel Yankee drier to which a protective coating according to the present invention can be applied.

The Yankee drier shown in FIG. 1 is of the type comprising support pins (2, 6) connected through the end heads (13, 14) to the cylindrical steel mantle (15). The pins (2, 6) have a coaxial opening through which steam is introduced. The steam expands inside the central chamber (3) delimited by the internal surface of the tie rod (12) that has the dual function of making the ends heads (13, 14) to cooperate against the steam pressure, that typically can reach a value of 10 bar of relative pressure, and supporting the system for extracting the condensate that is produced in the internal surface (1) of the mantle (15). The system for extracting the condensate is not shown. The tie rod (12) is typically a tubular body internally coaxial to the mantle (15). The Yankee drier is made to rotate around the axis of pins (2, 6) at a predetermined speed.

The steam passes from the tubular inner chamber (3) to the annular external chamber (4), delimited by the internal surface (1) of the mantle (15) and the external surface of the tie rod (12), through holes (5) provided on the surface of the latter.

In operation, the paper (7) adheres to the external surface (11) of the mantle (15). The paper covers the most part of the mantle surface along the width of the latter, leaving uncovered only the connection areas between the end heads (13, 14) and the mantle (15). The part of the steel mantle comprised between the internal surface (1) and the paper (7) is the part through which takes place the most part of thermal exchange originating from the heat introduced through the steam. The heat transmission causes the steam to condensate. The condensate (C), due to centrifugal force, tends to accumulate on the radially outermost parts of the internal surface (1) of the mantle (15).

Typically, the Yankee driers have circumferential grooves (8) formed on the internal surface of the mantle (15). Said grooves have a dual function: to increase the heat exchange surface increasing the thermal efficiency of the system and collecting the condensate that concentrates on the bottom of the same grooves. The condensate extraction system (not shown) is typically composed of a series of tubes placed with their respective ends at a predetermined distance from the bottom of the grooves (8). The steam is generally introduced in a larger amount in relation to the amount strictly required, such that not all the steam is subjected to condensation and a certain amount of steam is used as a carrier for removal of the condensate. Therefore, through the tubes of the condensate extraction system is removed thanks to the excess of steam.

Figure 2:
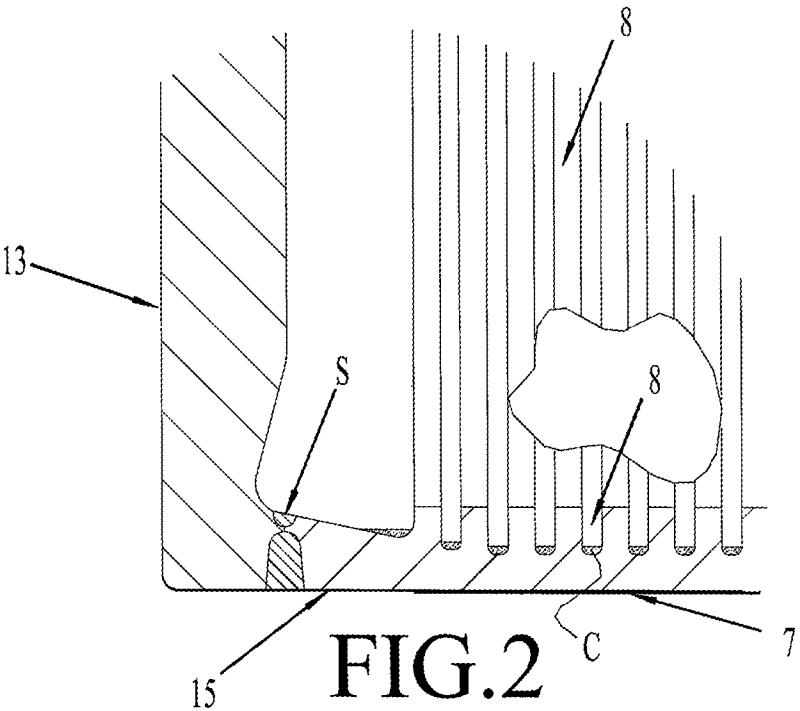
FIG. 2 is an enlarged detail of FIG. 1 in which are particularly shown the circumferential grooves formed on the inner surface of the mantle.

In FIG. 1 the end heads (13, 14) are welded to the mantle (15) and the latter has a plurality of grooves (8) on its internal surface. Reference numerals (20) and (60) denote bearings by which the pins (2, 6) are connected to a fixed structure (not shown) that supports the Yankee drier. The reference "S" in FIG. 2 and FIG. 3 denotes the welds connecting the mantle (15) with the end heads.

Figure 5:
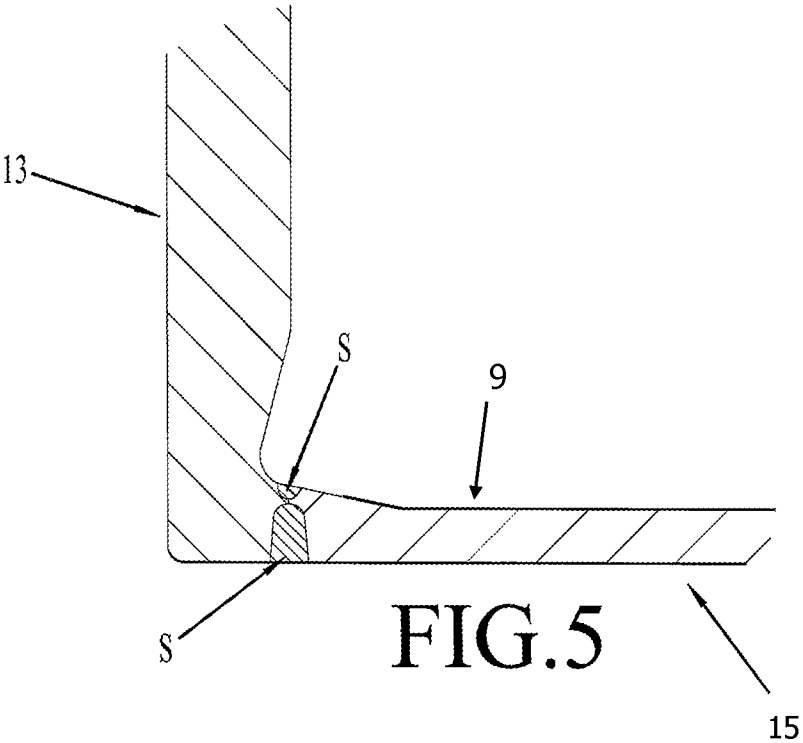
FIG. 5 shows a further embodiment of a Yankee dryer according to the present invention.
Figure 6:
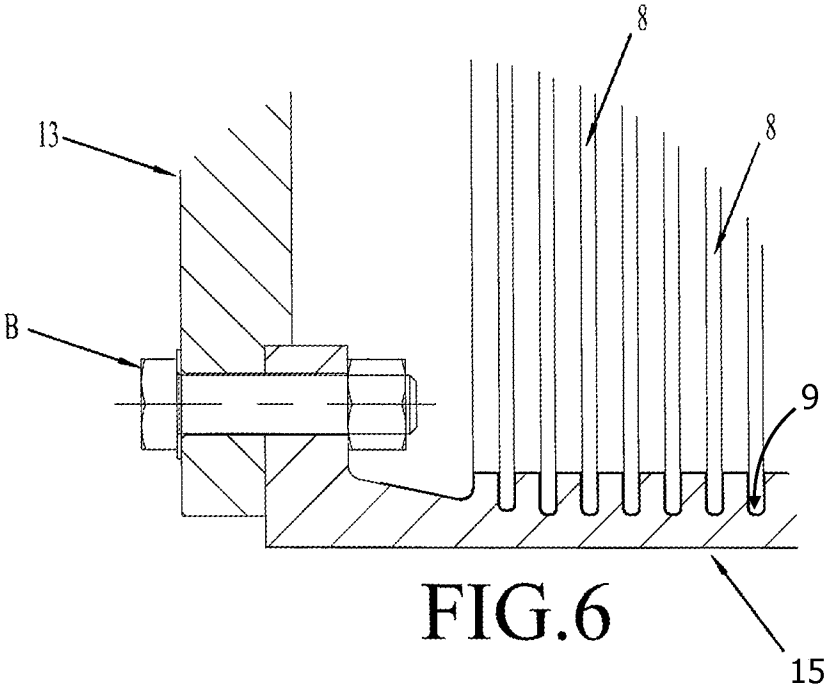
FIG. 6 shows a further embodiment of a Yankee dryer according to the present invention.
Figure 8:
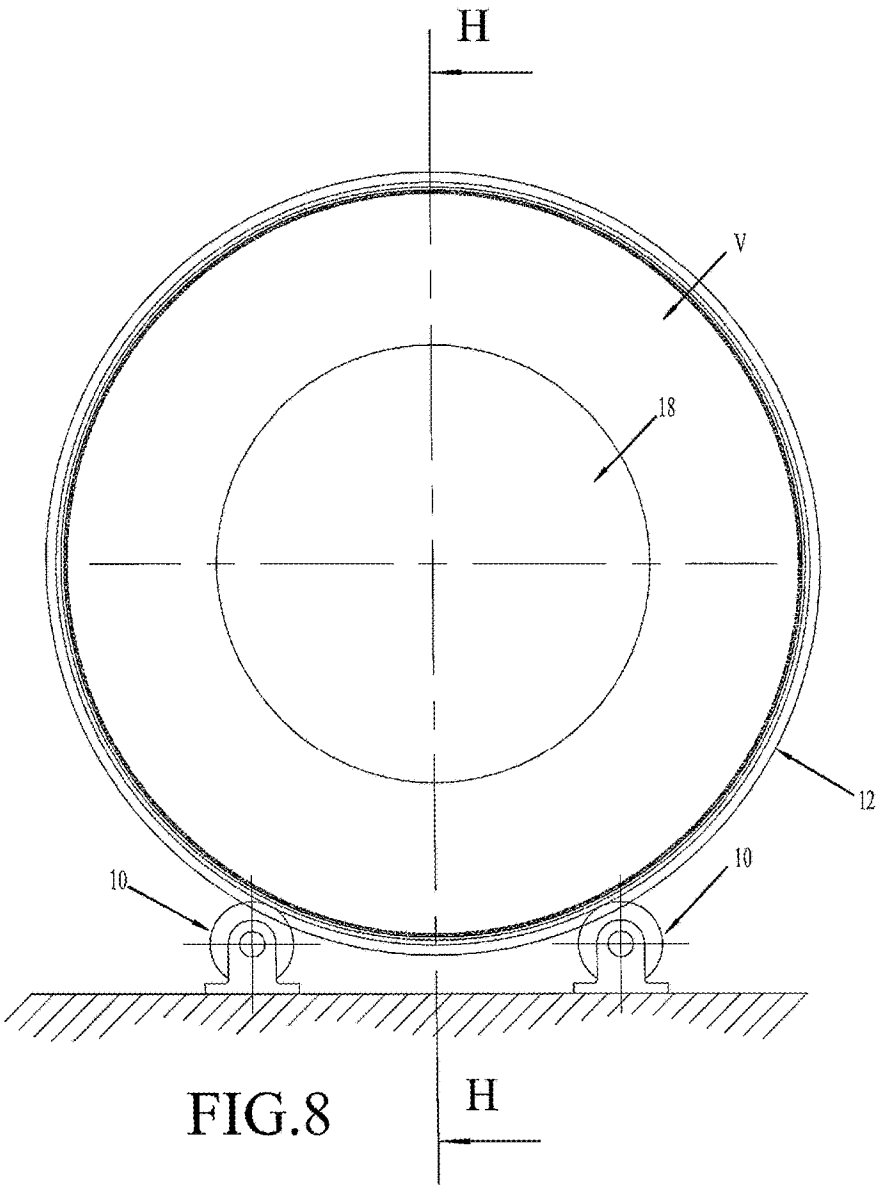
FIGS. 8-20 schematically show steps of execution of a protective coating for a Yankee drier according to the present invention, where
Figure 9:
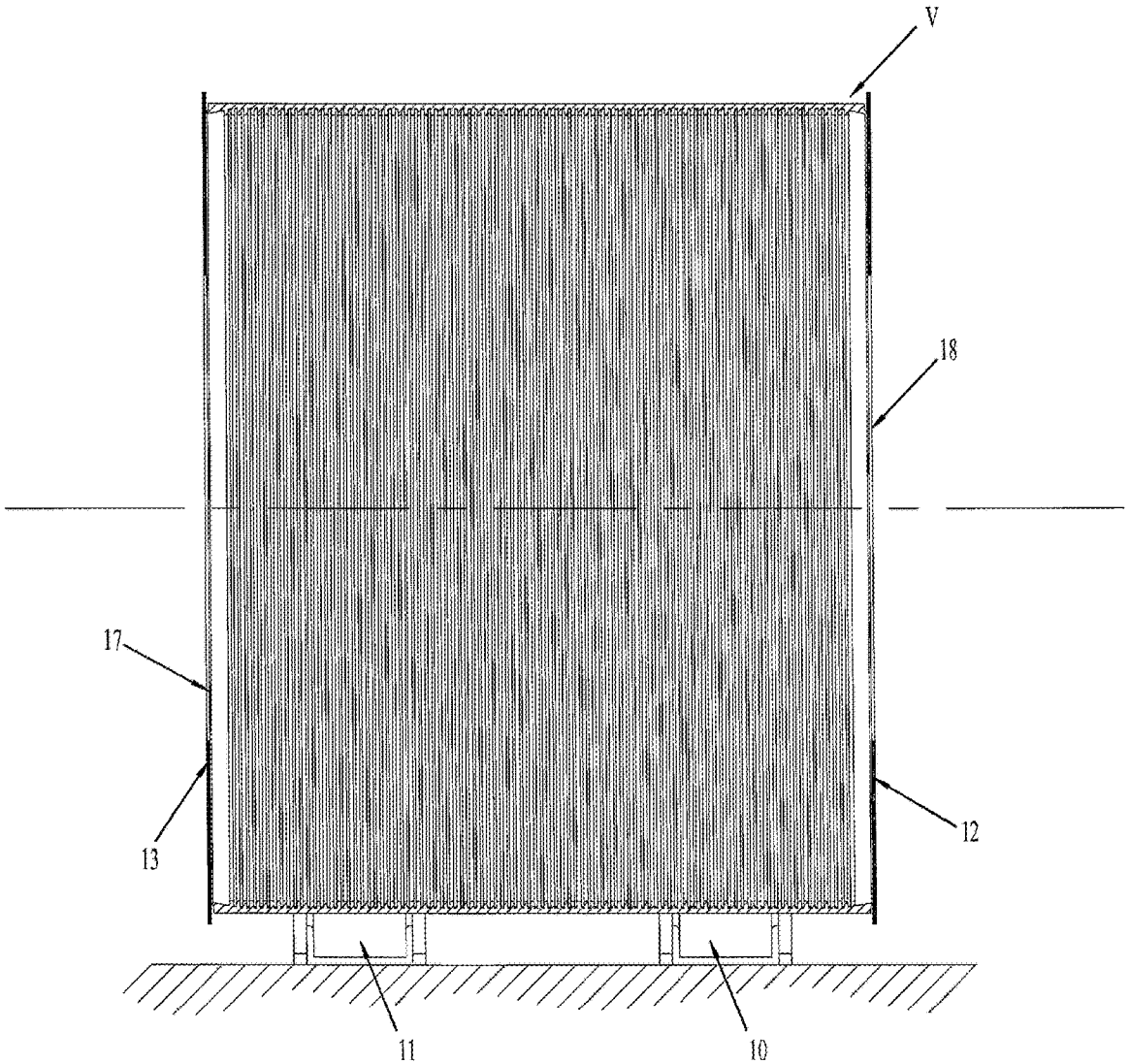
Figure 13:
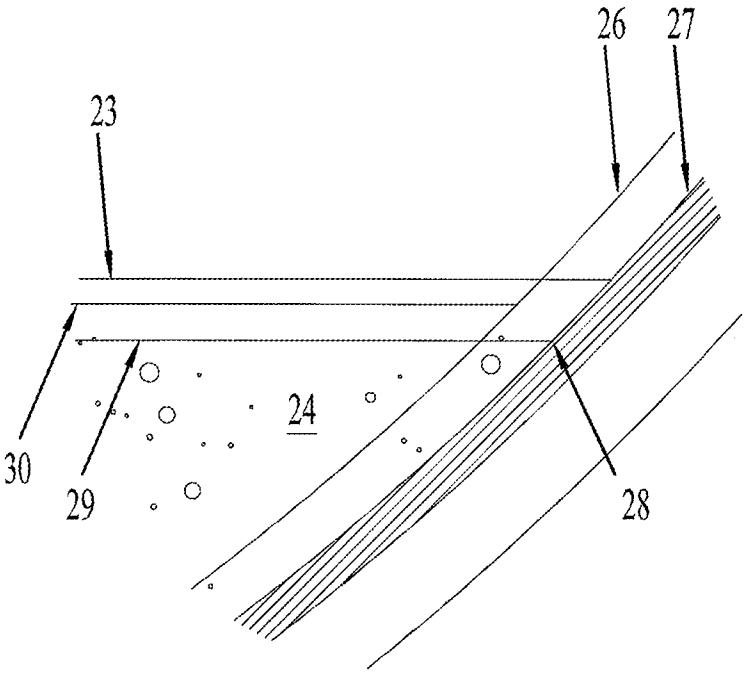

The present invention also applies to Yankee driers made in a different way like, for example, Yankee driers made as shown in FIG. 5, in which the afore mentioned grooves are not provided and the internal surface of the mantle (15) is smooth, or as shown in FIG. 6, in which the mantle (15) is bolted, instead of being welded, to the end heads that can be made either of materials different from steel (cast iron, for example) or produced through different techniques (for example by steel or cast iron casting or by welding metal sheets). Reference "B" denotes the bolt connection between the mantle (15) and the end heads.

Figure 3:
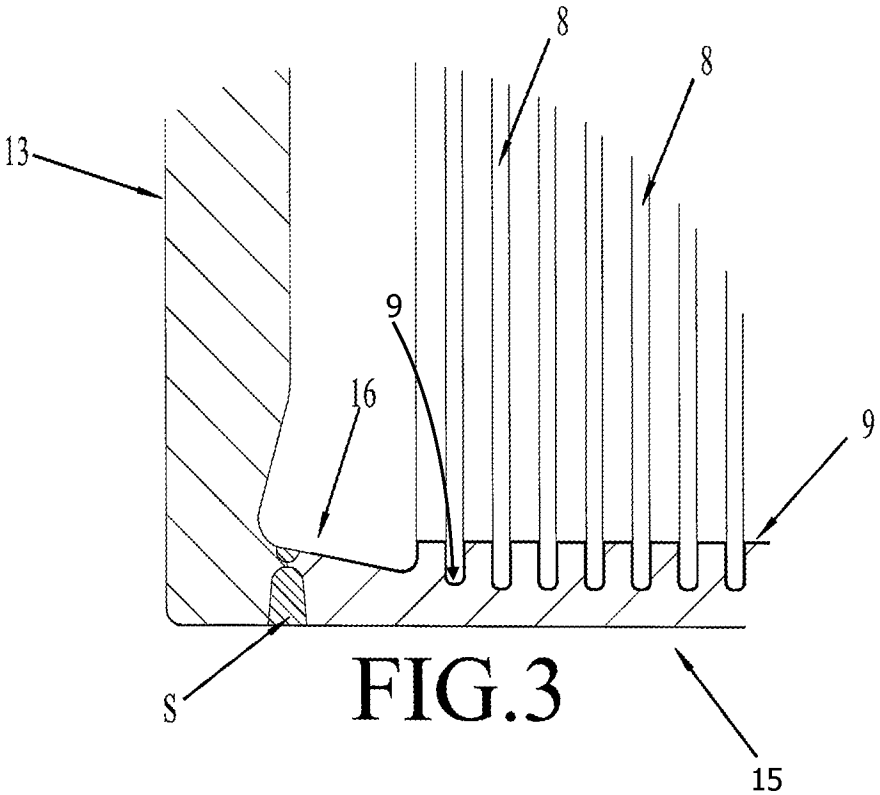
FIG. 3 is similar to FIG. 2 but it shows, in particular, the protective coating formed in accordance with the present invention.

FIG. 3 shows the protective coating (9) on the internal surface (1) of the mantle. The protective coating preferably covers the surface (1) substantially up to zone (16) of junction with the end heads. In this way, the protective coating covers all areas potentially more prone to corrosion, i.e. the areas where condensate forms as mentioned before and, more particularly, where the condensate is collected. The extension of the protective coating beyond said areas, although not excluded by the present invention, involves the consumption of a greater amount of the materials used for making the protective coating with higher costs.

Figure 4:
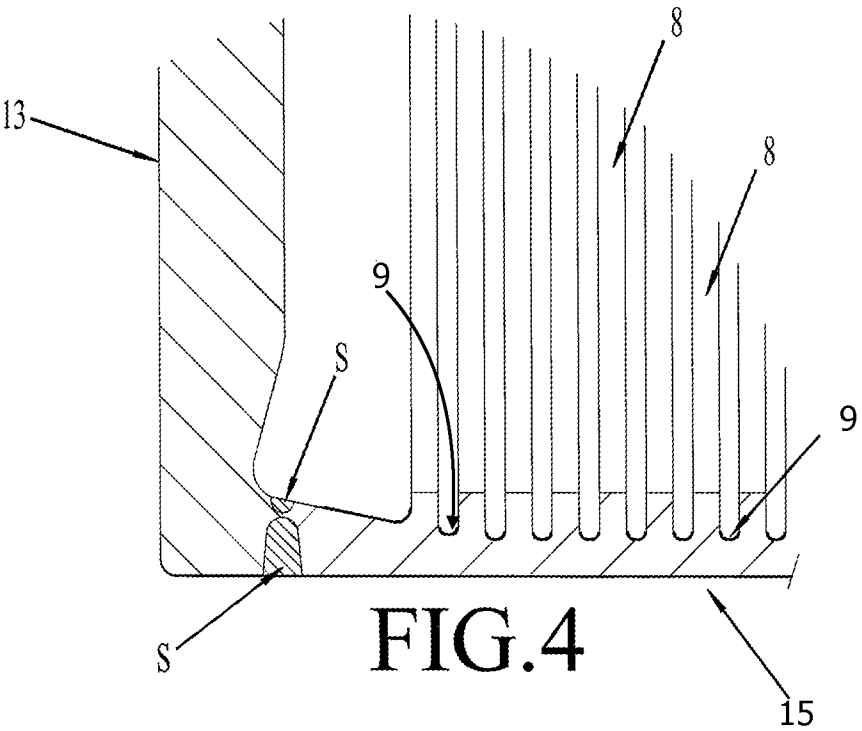
FIG. 4 shows an alternative way of forming a protective coating according to the present invention.
Figure 7:
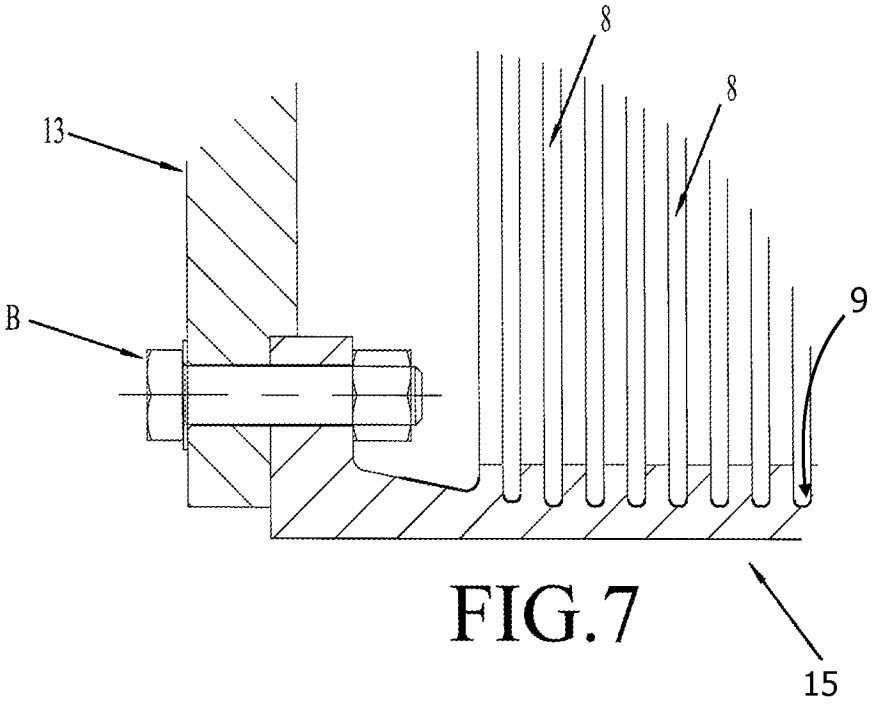
FIG. 7 shows a further embodiment of a Yankee dryer according to the present invention.

A further configuration is shown in FIGS. 4 and 7: in this case, the protective coating is only on the surfaces where the condensate is collected (that are the more critical areas for the corrosion induced by the corrosion mechanism described above) but not on the surfaces that come into contact with the steam or the forming condensate. This configuration reduces the amount of protective coating to be applied for internally protecting the Yankee drier accepting a lower protection on less critical areas.

FIG. 5 shows the case of a Yankee drier not internally provided with circumferential grooves, i.e. having an internal smooth cylindrical surface.

In the drawings, the protective coating (9) is generally represented by a thicker line.

The following description provides a possible way of applying the protective coating and involves the so-called high phosphorus nickel plating. Compared to other techniques for forming protective coatings on metal bodies, it provides the following advantages:

- it is possible to realize a metal protective coating having a higher thermal conductivity compared to spraying or metallization;
- high phosphorus nickel plating implies a high adhesion to surfaces of different nature;
- nickel is typically a highly ductile metal suitable, therefore, to tolerate high deformations without being damaged;
- high phosphorus nickel plating allows deposition of protective coatings having a very low thickness (a few micrometers). The high thermal conductivity, however, allows the formation of thicker protective coatings (typically within 100 micrometers) without negatively affecting the thermal exchanges;
- It is possible to obtain a high surface hardness (higher than 350 HV measured at room temperature) which implies a higher resistance to the possible erosion due to the entrainment of hard particles by the flows of the condensate extracted from the drier.

Nickel plating is an auto-catalytic process allowing the deposition of a Nickel-Phosphorus alloy layer on a metal substrate.

The nickel is used in solution in solution in the form of salts thereof ($NiSO_4$) and then precipitates thanks to its chemical reduction. The reducing agent is identifiable in the hypophosphite ion ($H_2PO_2$) present in the nickel bath as sodium hypophosphite ($NaH_2PO_2$).

The speed at which the alloy is deposited and the phosphorus content depend on the amount of phosphite and hypophosphite in the nickel bath.

The process described above is represented by the flowing equation:

$$H_2PO_2+Ni_2+H_2O \rightarrow Ni+2H+H_2PO_3^-$$

The thickness of the Ni—P alloy deposited according to this technique is very uniform on all points of the surface to be coated and depends on the time of contact with the bath. By this process it is generally possible to treat pieces having a relatively complex geometry, realizing a protective coating having a uniform thickness over the entire surface of the treated pieces. A further advantage of the nickel plating is that the protective coating is sufficiently hard and resistant to corrosion in relation to its application to the manufacturing of Yankee driers.

The metallurgical properties of the deposited protective coating are function of the phosphorous content. According to the phosphorous content three categories can be defined:

- low phosphorous content alloys (P comprised between 2% and 4%);
- medium phosphorous content alloys (P comprised between 5% and 11%);
- high phosphorous content alloys (P comprised between 11% and 14%);

A high phosphorous content alloys is preferred for realizing a protective coating by chemical nickel plating in accordance with the present invention: such a protective coating will exhibit, in fact, higher corrosion resistance and ductility that are suitable for this specific application.

Typically, chemical nickel coating is implemented by immersing the component to be coated in a chemical bath having a given chemical composition, at a predetermined temperature and a given degree of turbulence.

In accordance with the present invention, there is a need to coat only the internal surface of the Yankee drier. Yankee driers are extremely larger than components normally subjected to chemical nickel plating. To this end, it is useful to consider that the most compact Yankee driers have a minimum diameter of 2-3 m and a width of 3 m; larger Yankee driers can have a diameter exceeding 6-7 m and a width higher than 6 m. Since Yankee driers are pressure vessels subjected to fatiguing stress, the thickness of the structural parts is high, therefore their weight can easily exceed tens of tons (the bigger Yankee drier can have a weight of more than 150 tons). Nickel plating by immersion of objects having such a size would be a very complex operation because it would require the immersion of the Yankee drier, or at least the mantle, in a enormous tank completely filled with a nickel bath. Such an approach would involve a number of drawbacks that would reduce its convenience. In fact, the tank would have to be of such dimension to contain the Yankee drier, special supports for supporting the Yankee drier inside the Yankee drier would be required, and a large amount of nickel bath would be required for at completely covering the Yankee drier or partially covering the latter providing means for ensuring the contact of the bath with all surfaces to be coated.

The purpose of the protective coating according to the present invention is the protection of internal surfaces of the Yankee drier, i.e. surfaces coming into contact with steam and forming condensate, while the coating of other surfaces of the Yankee drier, where the absence of condensate eliminates the risk of oxidation and corrosion, is not required.

The complete immersion of the Yankee drier in the nickel bath, as normally occurs for smaller components, would inevitably lead to the coating of all surfaces in contact with the bath, including those surfaces for which a protective coating is not required. In the context of the present invention, this would imply unnecessary additional costs since the formation of protective coating implies consumption of nickel and phosphorus contained in the nickel bath. In addition, some of the surfaces coated by the protective coating following a total immersion of the Yankee drier in the nickel bath should be brought back to their non-coated state. This further process step would concern, in particular, the external surfaces of the Yankee drier that must be metallized and, in particular, the surfaces that delimit welds to be made in the subsequent manufacturing step. For example, if the mantle is immersed in the nickel bath before connecting the end heads to the mantle and a welded connection between these parts is required, the surfaces provided for the subsequent welds should be further machined to eliminate the nickel-phosphorus coating, due to the presence of phosphorus that, once dissolved in the welding substances normally used, would cause unacceptable welding defects and impurities. In addition, the chemical reaction producing the formation of the protective coating requires heating of the nickel bath at a given minimum temperature. Indicatively, the reaction activates when the nickel bath temperature is above 60° C. A large amount of nickel bath would require heating means capable of transmitting large quantities of heat, with large energy loss, in order to reach the required temperature in a reasonable time. Moreover, a large tank for immersing the mantle in the nickel bath would have large containment surfaces and, therefore, would imply large thermal losses and additional heat for maintaining the required temperature over the time needed for completing the coating process.

Thus, in summary, the technique normally adopted in industrial chemical nickel-plating processes would imply great technological/engineering difficulties to obtain the coating of a large component like a Yankee drier. Furthermore, excessive amounts of nickel and phosphorus would be used for coating surfaces that do not require coating. Further economic inefficiencies would derive from the thermal energy required to heat an unnecessarily large nickel bath.

The example described below provides a method for using a chemical nickel-plating technique optimized for the internal surfaces of a Yankee drier.

The concept on which the following example is based is that the protective coating is not provided by immersing a Yankee drier in a nickel bath but it is provided by using the internal surface of the Yankee drier as a container for the nickel bath.

Figure 10:
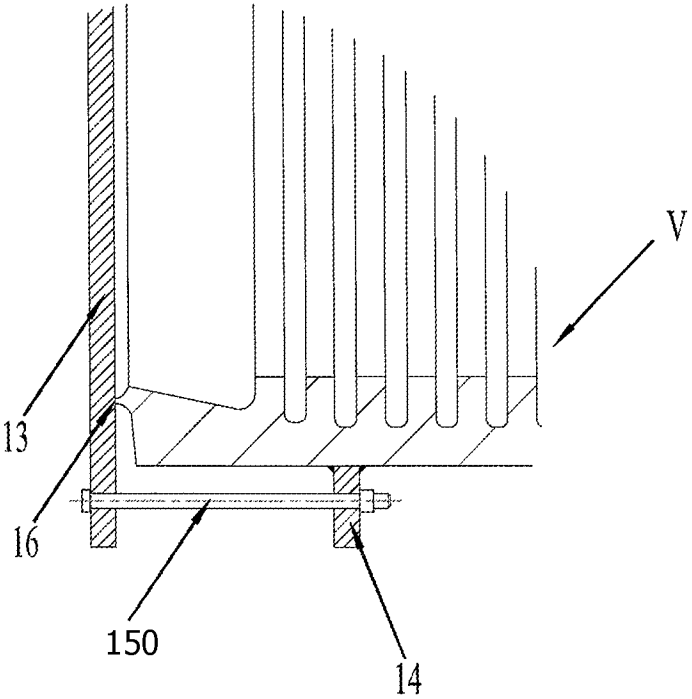
Figure 11:
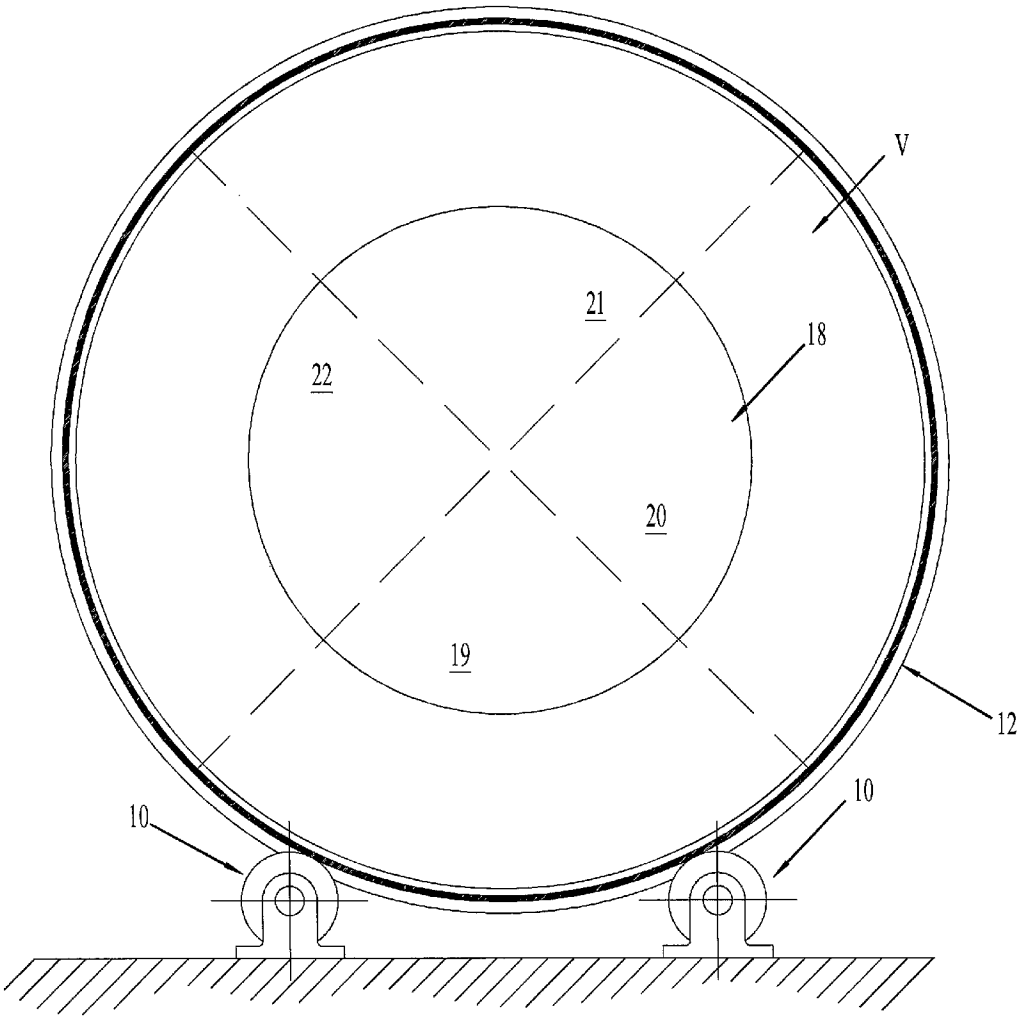

According to the preferred embodiment of a method for forming a protective coating as shown in FIGS. 8-20, the mantle, i.e. the cylindrical part (V) of the Yankee drier delimited by the mantle (15), completely internally machined (i.e. exhibiting the shape that it will have at the end of the manufacturing process), is placed on a support that preferably allows the rotation of the same mantle around the longitudinal axis thereof. For example, the mantle is placed on two pairs of rollers (10, 11) at least one of which is motorized to drive the rotation of the mantle when required. A cap (12, 13) is fixed to each of the side ends of the mantle, said caps preferably having a discoid shape. These caps are intended to delimit a space in which the nickel bath can be contained. The caps (12, 13) are stably but reversibly fixed at the side ends of the mantle. To this end, the caps can be screwed or welded to the side ends of the mantle. FIG. 10 shows a possible way for making such connection: a ring (14) is welded on the outer surface of the mantle in proximity of a side end of the latter and the cap (13) is fixed to the ring by means of bolts (150) distributed circumferentially around the cap so as to evenly distribute the contact pressure between the cap and the side end of the mantle. The area (16) of contact between the cap and the mantle will be adequately sealed to avoid spills of nickel bath. The same procedure applies for fixing the other cap (12) on the other side end of the mantle. Preferably, the caps (12, 13) have a central circular opening (17, 18) for facilitating the introduction of components inside the mantle.

Once the caps (12, 13) are mounted, the nickel bath can be introduced in the mantle.

The nickel bath is composed of a mixture of nickel salts and sodium hypophosphite. The nickel bath may also comprise:

- additives acting as complexing agents blocking a part of the Nickel ions and slowing down the precipitation of byproducts of the reaction such as organic hydroxy acids;
- stabilizers that prevent the decomposition of the nickel bath like slats of heavy metals or cyclic compounds;
- accelerators that increase the deposition rate, like dicarboxylic aliphatic acids;
- wetting agents that favor the wettability of the surfaces to be coated and facilitate the detachment of hydrogen bubbles, like mixtures of cationic and anionic surfactants.

Figure 12:
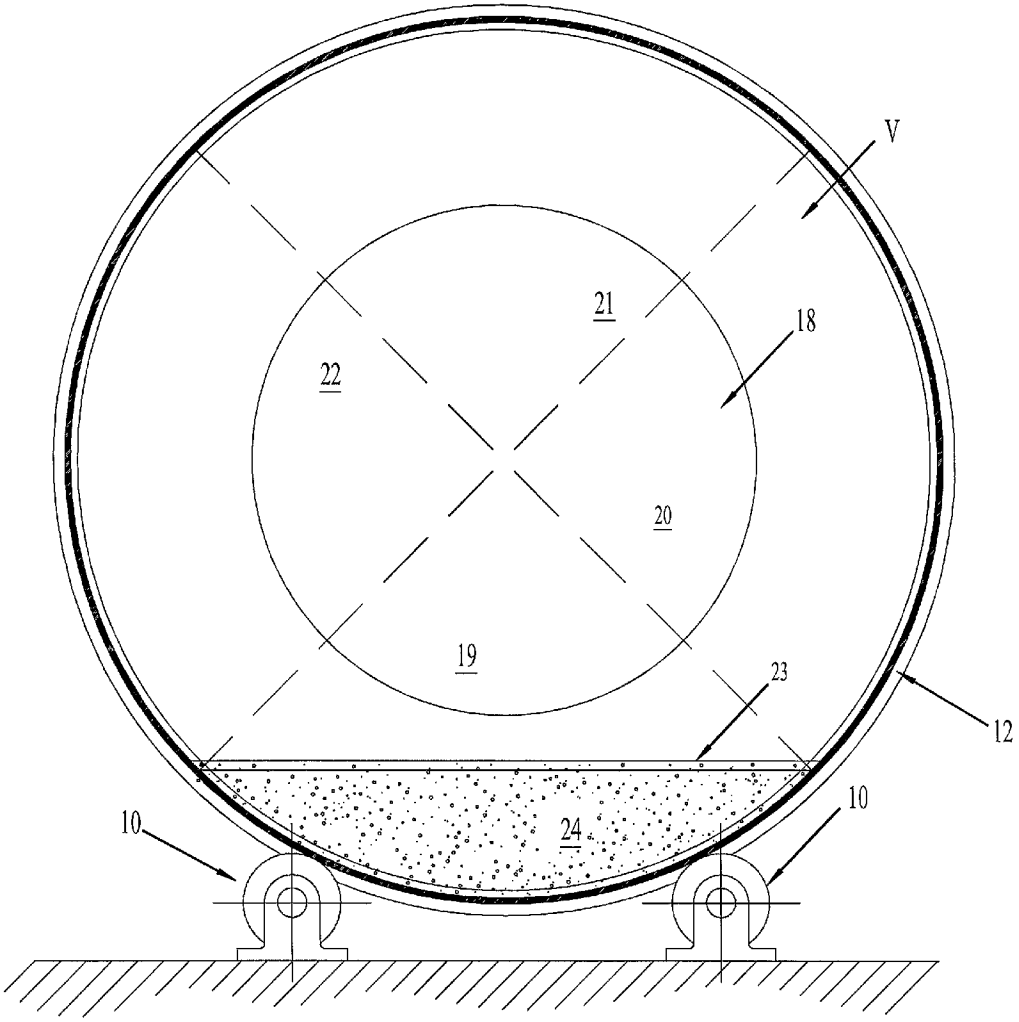
Figure 14:
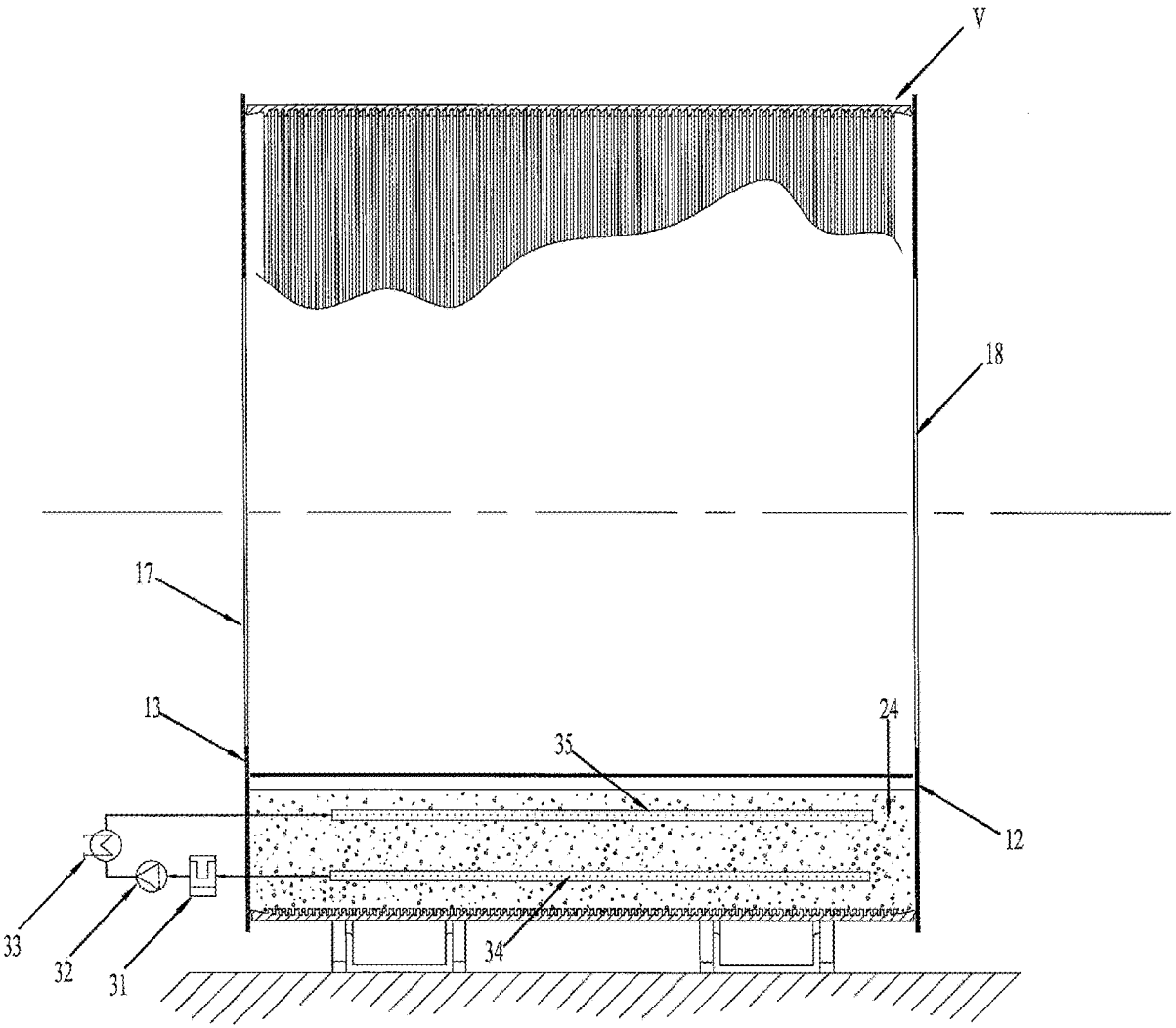
Figure 15:
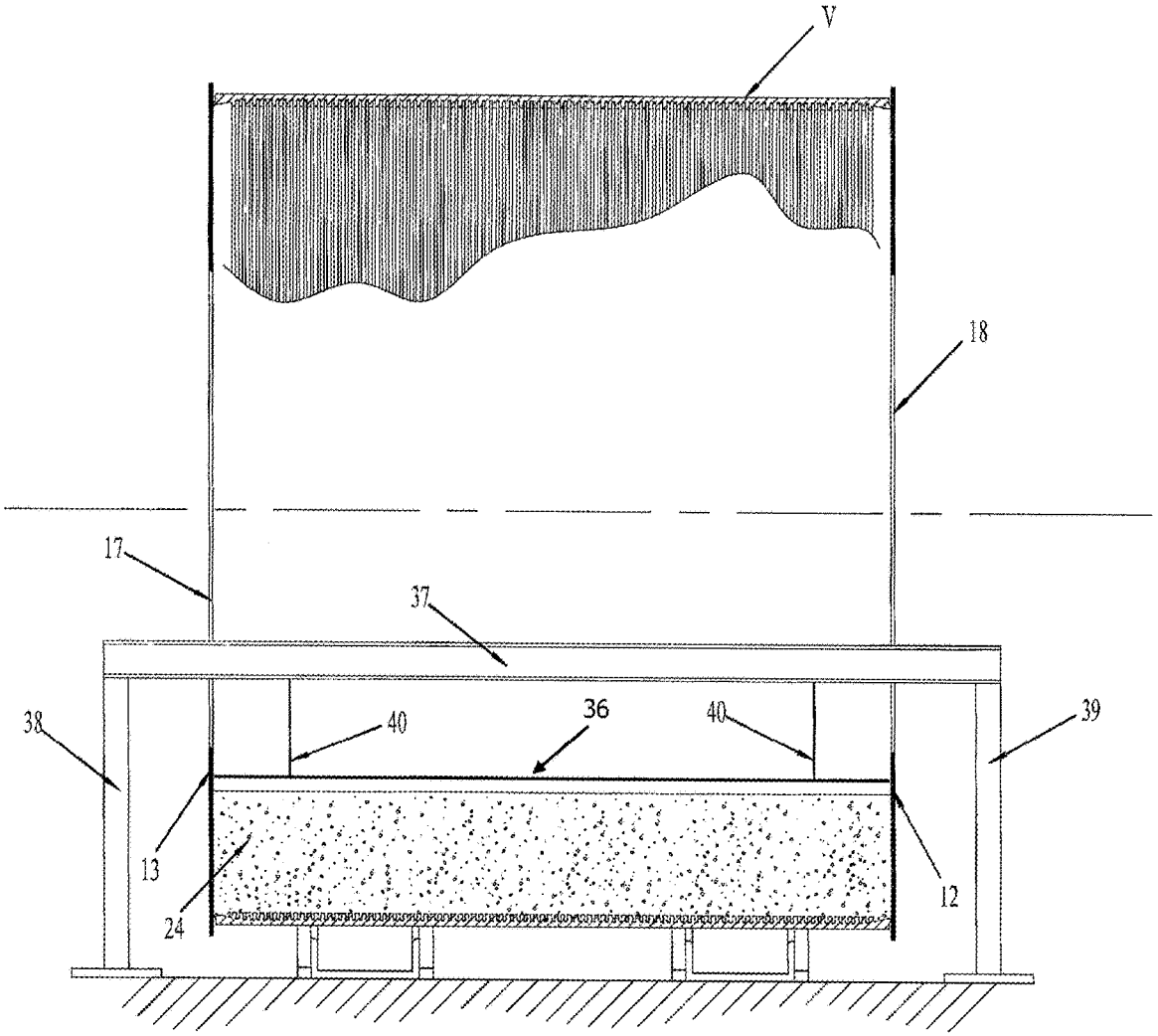
Figure 16:
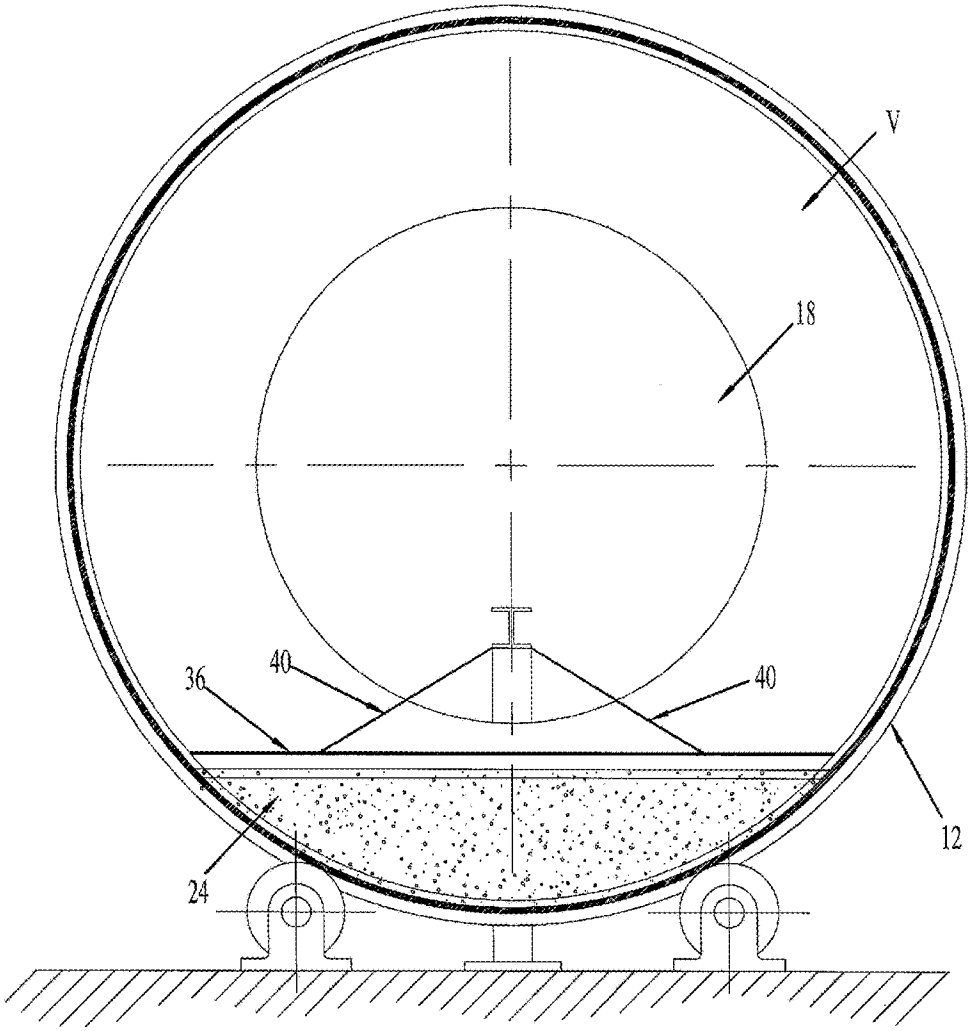

The nickel bath (24) will not completely fill the volume inside the cylindrical mantle. FIG. 12 is a cross section showing the mantle with nickel bath inside it. In this embodiment of the method for applying a protective coating, the mantle is ideally divided into four circular sectors (19, 20, 21, 22). The number of said sectors is purely exemplificatory and not binding.

The amount of nickel bath initially introduced in the mantle and laterally contained by caps (12) and (13) is such that the upper level (23) of the nickel bath is preferably above the chord (29) of the lowermost sector (in the drawing, the sector 19), formed on the circumference (27) defined by the bottoms of grooves (8) formed in the mantle. The level (23) can also preferably be above the chord (30) of sector (19) formed on the circumference (26) defined by the radially innermost part of the grooves (8). In this way, when the mantle will be rotated to expose another sector (for example, sector 20) to the nickel bath, there will be a superimposition of the protective coating formed in the first step to the protective coating formed in the subsequent step. Therefore, it will be possible to completely coat the internal surface of the mantle that will be in contact with the condensate when the Yankee drier will be in operation.

The preferably circular openings (17, 18) formed in the caps (12, 13) are such that they always remain above the level (23) of the nickel bath, even after a complete rotation of the mantle around its longitudinal axis.

Once introduced in the mantle, the nickel bath must be brought to a temperature suitable for the desired deposition (typically, a temperature comprised between 60° C. and 95° C.). During this phase, the mantle is stationary. For heating the nickel bath, it is possible to make use of both heating means placed externally to the mantle and heating means immersed in the nickel bath. For example, it is possible to make use of radiant lamps placed externally around the mantle so as to selectively or simultaneously heating the sectors mentioned above. In this case, the lamps can be uniformly distributed to uniform the temperature of the outer surface of the mantle subjected to heating and avoid areas that are heated more than others. Alternatively, or in addition, it is possible to make use of heating means totally or partially immersed in the nickel bath. For example, immersed electric heating resistors can be used.

To speed up the activation of the chemical deposition process, the nickel bath can be pre-heated before introducing it into the mantle.

Preferably, the nickel bath is recirculated inside the mantle for two reasons: a limited turbulence of the nickel bath facilitates removal of hydrogen micro-bubbles that tend to adhere to the treated surface. A second reason is that the content of nickel, phosphorus and other substances contained in the bath progressively decrease while the reaction takes place and the protective coating is formed. If the nickel bath is not mixed, some parts of the latter could have a non-uniform concentration due, for example, to a (even if limited) an uneven distribution of the temperature.

The mixing and turbulence in the nickel bath can be obtained in different ways. A preferred embodiment, schematically represented in FIG. 14, foresees an external bath recirculation system comprising, for example, one or more suction points (34) for sucking the bath from the mantle (for example, one or more tubes with a single opening or multiple distributed openings), one or more filters (31) for keeping the nickel bath free from deposits and contaminants that could determine defects in the coating under formation, one or more pumps (32) and one or more re-introduction points (35) for re-introducing the bath in the mantle.

Another embodiment can foresee a heater (33) placed at any point of the recirculation system, preferably downstream of the filter (preferably an electrical heating resistor). This heater can cooperate with, or substitute the, heating system for heating the nickel bath disclosed above.

A cover (36) can be placed above the nickel bath, preferably not rigidly connected with the mantle so as to allow the latter to rotate without having to reposition the cover (36) at each rotation of the mantle. The purpose of said cover is to hinder the dispersion of vapors produced by the reaction: the nickel bath, even if not brought to the boiling point, can be brought o relatively high temperatures (preferably up to 95° C.) such that a high evaporation is expected, due also to recirculation and turbulence mentioned above. The presence of a cover allows the condensation of part of the vapors and its re-introduction (for example, by dripping) into the nickel bath. In this way, at least two advantages are obtained: the nickel bath consumption is reduced such that reintegration of demineralized water in the nickel bath is also reduced, and thermal losses are limited, thus reducing the thermal power required for reaching the desired temperature and its control during the process.

Preferably, said cover is as large as possible to increase its efficiency. Ideally, the maximum efficiency is achieved by completely covering the nickel bath.

As said above, the cover (36) is preferably stationary also during rotation of the mantle. Therefore, preferably, the cover is supported by a structure constrained to a part external to the mantle, for example supported by a beam (37) passing through the openings (17, 18) of the caps (12, 13) and supported by columns (38, 39) bearing on the ground externally to the mantle. The cover can be connected to the beam (37) by means of cables or tie rods (40).

Preferably, said cover is made of a thermally insulating material or it is coated with a thermally insulating material. Preferably, said cover can be provided with coverable openings allowing visual inspection of the nickel bath or collection of samples to be analyzed.

Once the nickel bath has been brought to a temperature higher than the reaction triggering temperature, the Ni—P coating deposits on the treated surfaces. The deposition rate will also depend on the temperature of the nickel bath (a higher temperature will imply a higher deposition rate).

Preferably, the mantle is kept stationary for a time sufficient to allow the deposition of the protective coating having the desired thickness. During the reaction process, it will be possible to manually or automatically add substances containing nickel and/or phosphorus to avoid excessive variations of the nickel bath composition with respect to the starting composition, variations due to the progressive deposition of nickel and phosphorus. Other substances can be added to the nickel bath (for example, pH regulators) in order to keep the acidity of the solution within the limits required for the reaction.

Figure 18:
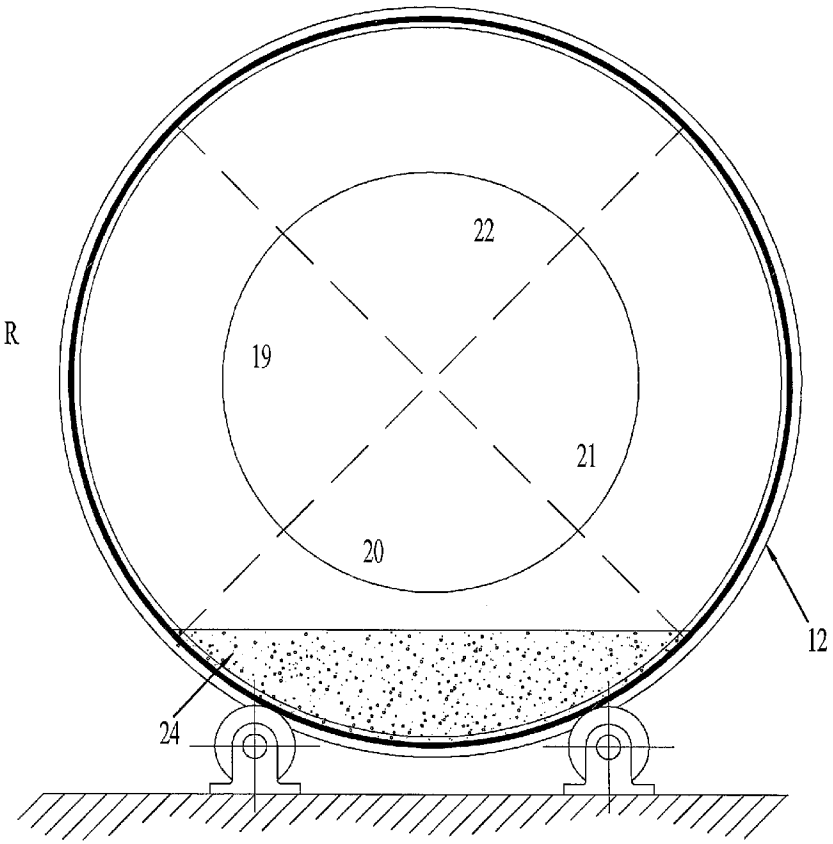
Figure 17:
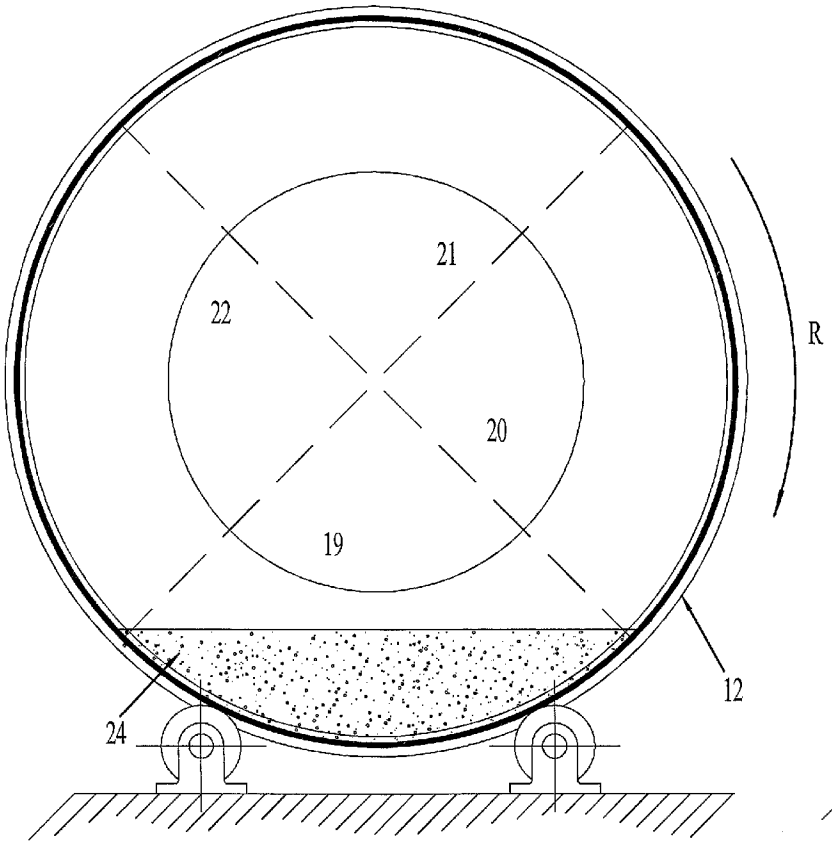

Once the surface of the mantle corresponding to the first of the above-mentioned sectors has been exposed to the reaction for the predetermined time required for the deposition of the protective coating having the desired thickness, the mantle is rotated about its longitudinal axis through rollers (10) and (11). The rotation of the mantle, indicated by the arrow "R" in FIG. 17, will bring the cylindrical surface of the next sector (in this case the sector 20) in the lowermost position, such that the nickel bath will enter into contact with such surface. Said rotation is schematically shown in FIGS. 17-18. Once reached this new position, the mantle is stopped and is kept stationary for the time required to form the protective coating on the surface exposed to the nickel bath.

As said above, the level (23) of the nickel bath is such that, preferably, there is an overlapping of the protective coating at the ends of the surfaces exposed to the nickel bath in order to avoid uncoated areas in the mantle inner surface to be coated.

Preferably, the surface of the mantle corresponding to the sector (20) is pre-heated before being brought into contact with the nickel bath, the pre-heating bringing said surface at a temperature lower than, or equal to, the temperature of the nickel bath such that, when there is the contact of the surface with the nickel bath, the temperature of the latter is not excessively or quickly reduced given the high thermal conductivity of the mantle. An excessive or too quick decreasing of the bath temperature (indicatively, a temperature decrease of 10° C. occurring during said rotation) could slow down or interrupt the reaction providing the deposition of the protective coating that, as a consequence, could be defective or it could have a thickness lower than the desired thickness.

The step disclosed above is repeated as many times as the number of sector subdivisions. Therefore, at the end of the process, the entire internal surface of the mantle exposed to the nickel bath will be coated by a protective coating having a substantially uniform thickness with the exception of said overlapping zones where the protective coating will have a higher thickness. According the example disclosed above, said operation is executed four times, i.e. for each of said sectors (19, 20, 21, 22).

Figure 19:
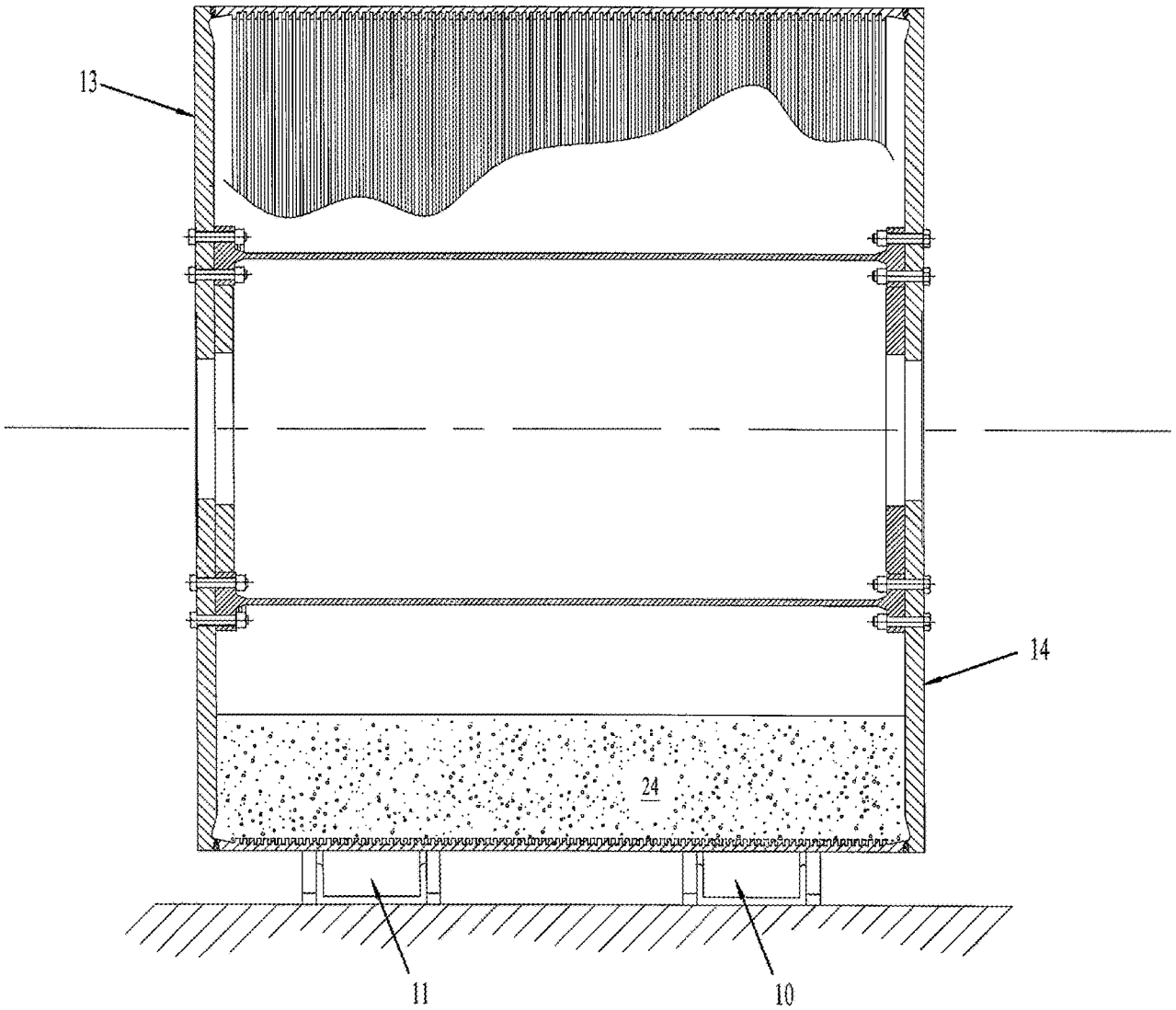
Figure 20:
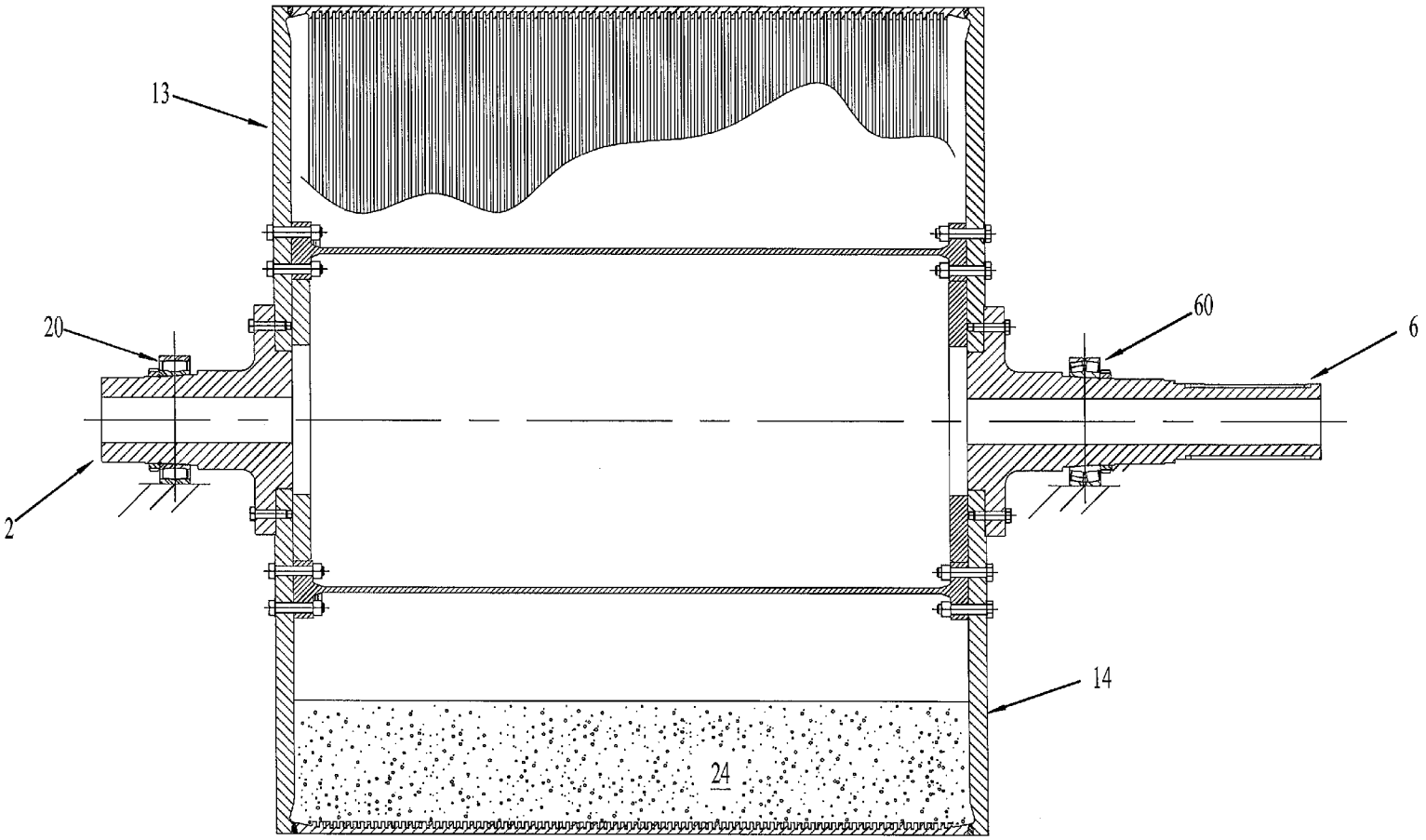

In some other embodiments, the mantle can be attached to the end heads (13, 14), as shown in FIG. 19, before it is made to rotate, as previously disclosed, by means of rollers (10, 11), or the pins (2, 6) can be mounted, as shown in FIG. 20, such that the Yankee drier can be supported by the bearings (20, 60). This further implementation of the internal nickel plating allows the internal coating of Yankee driers that are already installed in paper mills. In this case, the nickel bath (24) can be introduced into the Yankee drier, and extracted from the latter, through the axial holes typically formed in said pins and in the end heads (13, 14).

According to an alternative implementation of the process, the mantle can be rotated about its axis also during the reaction, i.e. during the deposition of the protective coating. In this way, overlapping zones of protective coating are avoided. In this case, the protective coating is formed by superimposed layers formed along the internal cylindrical surface of the mantle. The number of the superimposed layers will be equal to the number of complete rotations of the mantle.

In practice the execution details may vary with regard to the elements described and illustrated, without thereby departing from the adopted solution and therefore remaining within the limits of the protection granted by this patent in accordance with the appended claims.

The invention claimed is:

1. A method for manufacturing a steel Yankee drier comprising a cylindrical steel mantle to which two end heads are connected, on each of which a corresponding pin is arranged, wherein the cylindrical mantle has an external surface and an internal surface, and wherein the internal surface of the mantle in cooperation with the end heads delimits an internal chamber of the Yankee drier in which steam can be introduced, wherein a surface protective coating is at least partially formed on the internal surface of the mantle by introducing a predetermined amount of a nickel bath in a volume delimited in a radial direction by the internal surface of the mantle, followed by a permanence of the bath in said volume for a predetermined time, the surface protective coating protecting the internal surface of the mantle from corrosive and/or abrasive agents contained in the steam introduced into said chamber.

2. The method according to claim 1, wherein said volume is subjected to rotation around a longitudinal axis of the mantle during the formation of the surface protective coating.

3. The method according to claim 2, wherein said rotation is continuous or intermittent.

4. The method according to claim 1, wherein the nickel bath comprises $NiSO_4$ and $NaH_2PO_2$ and determines the formation of the surface protective coating in accordance with the following reaction: $H_2PO_2^- + Ni^{2+} + H_2O \rightarrow Ni + 2H^+ + H_2PO_3^-$.

5. The method according to claim 1, wherein the nickel bath is at a temperature comprised between 60° C. and 90° C.

6. The method according to claim 1, wherein the mantle is preheated before receiving the nickel bath.

7. The method according to claim 1, wherein, during its permanence in said volume, the nickel bath is subjected to mixing.

8. The method according to claim 1, wherein the volume delimited radially by the mantle is a volume which is axially delimited by caps temporarily applied to the mantle or by the heads of the Yankee drier.

9. The method according to claim 1, wherein the mantle is put into rotation around its own longitudinal axis by means of rollers which transmit a rotary motion to the mantle by acting externally to the latter.

10. The method according to claim 1, wherein the end heads are welded or bolted to the mantle.

11. The method according to claim 1, further comprising a Yankee drier having one or more of:

- the surface protective coating has a degree of porosity defined by a percentage quantity of air or impurities in the volume unit of the protective coating itself lower than 10%;
- the surface protective coating resists to variations in length of the substrate constituted by the internal surface of the mantle (15) in excess of 1%, without being cracked or detached;
- the protective surface coating has a thermal conductivity coefficient higher than 3 w/m*K;

the surface protective coating has a thickness of less than 200 microns;

the surface protective coating causes an increase in the thermal resistance of the substrate on which it is applied not more than 10%, with respect to the thermal resistance of the substrate without the surface protective coating; and the surface protective coating has a hardness, measured at a room temperature of 25° C., greater than 350 HV.

12. The method according to claim 1, wherein the internal surface of the mantle is provided with circumferential grooves and the surface protective coating is applied on the circumferential grooves.

13. The method according to claim 1, wherein the internal surface of the mantle is smooth.

14. The method according to claim 1, wherein said nickel bath partially fills said volume.

15. The method according to claim 1, wherein the nickel bath is subjected to heating during its permanence in said volume.

16. The method according to claim 8, wherein said volume is laterally delimited by the end heads, and the pins are mounted to the end heads.

17. The method according to claim 1, wherein the nickel bath is preheated before being inserted in said volume.

18. The method according to claim 1, wherein the nickel bath is made to recirculate inside said volume.

19. A Steel Yankee drier that it is manufactured according to claim 1.

* * * * *